US006817708B2

(12) United States Patent
Kneezel

(10) Patent No.: US 6,817,708 B2
(45) Date of Patent: Nov. 16, 2004

(54) CONICAL OR CYLINDRICAL LASER ABLATED FILTER

(75) Inventor: Gary A. Kneezel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 80 days.

(21) Appl. No.: 10/283,417

(22) Filed: Oct. 29, 2002

(65) Prior Publication Data

US 2004/0080592 A1 Apr. 29, 2004

(51) Int. Cl.[7] ..... B41J 2/175

(52) U.S. Cl. ..... 347/93

(58) Field of Search ..... 347/93, 92, 85–87; 210/398, 493.1

(56) References Cited

U.S. PATENT DOCUMENTS

| | | | | |
|---|---|---|---|---|
| 4,571,599 A | | 2/1986 | Rezanka | 347/87 |
| RE32,572 E | | 1/1988 | Hawkins et al. | 156/626 |
| 4,774,530 A | | 9/1988 | Hawkins | 347/63 |
| 4,864,329 A | | 9/1989 | Kneezel et al. | 347/93 |
| 6,139,674 A | | 10/2000 | Markham et al. | 156/252 |
| 6,199,980 B1 | | 3/2001 | Fisher et al. | 347/93 |
| 6,464,347 B2 | * | 10/2002 | Kneezel et al. | 347/93 |
| 6,644,797 B2 | * | 11/2003 | Haines et al. | 347/93 |

* cited by examiner

*Primary Examiner*—K. Feggins
(74) *Attorney, Agent, or Firm*—Oliff & Berridge, PLC

(57) ABSTRACT

A microfluidic filter has a conical filter structure having a plurality of pores through the structure. Alternately the microfluidic filter can have a cylindrical filter structure or a coil structure of multiple cylindrical filters with decreasing radii. The pore structure of the filters is formed by laser ablation.

5 Claims, 14 Drawing Sheets

CONICAL OR CYLINDRICAL LASER ABLATED FILTER

BACKGROUND OF THE INVENTION

The present invention relates generally to a filter structure as typically used in microfluidic devices and, more particularly unique structures for a filter having particular use in an ink jet printer system, i.e. increasing fluid flow through a filter by increasing the surface area of the filter.

There is a trade-off in filter design between flow resistance and filter effectiveness especially for small particle size. Microfilters traditionally have a relatively high flow resistance although they offer precise filter sizing with 100 percent particle retention for particle sizes above the pore size of the filter. In thermal ink jet systems, for example, the implication for small enough pore size is that the printing frequency might be limited by the flow through the filter. For various drop sizes and printing frequencies, simple patterns of circular pores are adequate. However, there is a general interest in going to smaller drop sizes, e.g. (requiring a finer filter) and higher frequencies in the order of 15 khz and higher.

In new areas of microfluidics, microfluidic carrying devices and their components are small, typically in the range of 500 microns down to as small as 1 micron, and possibly even smaller. Such microfluidic devices pose difficulties with regards to maintaining and increasing fluid flow through the microscopic componentry, and, especially, when the particular microscopic componentry is connected to macroscopic sources of fluid. Yet such microfluidic devices are important in a wide range of applications that include drug delivery, analytical chemistry, microchemical reactors and synthesis, genetic engineering, and printing technologies including a wide range of ink jet technologies, such as thermal ink jet printing.

A typical thermally actuated drop-on-demand ink jet printing system, for example, uses thermal energy pulses to produce vapor bubbles in an ink-filled channel that expels droplets from the channel nozzles of the printing system's printhead. Such printheads have one or more ink-filled channels communicating at one end with a relatively small ink supply chamber (or reservoir) and having a nozzle at the opposite end. A thermal energy generator, usually a resistor, is located within the channels near the nozzle at a predetermined distance upstream therefrom. The resistors are individually addressed with a current pulse to momentarily vaporize the ink and form a bubble which expels an ink droplet.

Some of these thermal ink jet printheads are formed by mating two silicon substrates. One substrate contains an array of heater elements and associated electronics (and is thus referred to as a heater plate), while the second substrate is a fluid directing portion containing a plurality of nozzle-defining channels and an ink inlet for providing ink from a source to the channels. This substrate is referred to as a channel plate which is typically fabricated by orientation dependent etching methods.

The dimensions of the ink inlets to the die modules, or substrates, are much larger than the ink channels. Hence, it is desirable to provide a filtering mechanism for filtering the ink at some point along the ink flow path from the ink manifold or manifold source to the ink channel or from the ink channel to the nozzle to prevent blockage of the channels by various particles typically carried in the ink. Even though some particles of a certain size do not completely block the channels, they can adversely affect directionality of a droplet expelled from these printheads.

U.S. Pat. No. 4,864,329 to Kneezel et al. discloses a thermal ink jet printhead having a flat filter placed over the inlet thereof by a fabrication process which laminates a wafer size filter to the aligned and bonded wafers containing a plurality of printheads. The individual printheads are obtained by a sectioning operation, which cuts through the two or more bonded wafers and the filter. The filter may be a woven mesh screen or preferably a nickel electroformed screen with predetermined pore size. Electroformed screen filters having pore size which is small enough to filter out particles result in filters which are very thin and subject to breakage during handling or wash steps. Also, the preferred nickel embodiment for a filter is not compatible with certain inks resulting in filter corrosion. Finally, the choice of materials is limited when using this technique. Woven mesh screens are difficult to seal reliably against both the silicon ink inlet and the corresponding opening in the ink manifold. Further, plating with metals such as gold to protect against corrosion is costly. This patent is intended to be incorporated by reference herein in its entirety.

In all cases, conventional microfilters ordinarily suffer from blockage by particles larger than the pore size, and by air bubbles. Conventional microfilters used for thermal ink jet printheads help keep the jetting nozzles and channels free of clogs caused by dirt and air bubbles carried into the printhead from upstream sources such as from the ink supply cartridge. One common failing of all planar microfilters is their relatively high flow resistance and limited surface area for filter pores.

In laser ablated filters, circular holes are laser ablated in a flat planar plastic film, which may then be bonded over the ink inlets of many die at once in a thermal ink jet wafer, as taught in U.S. Pat. No. 6,139,674, to Markham et al. and U.S. Pat. No. 6,199,980, to Fisher et al., both commonly assigned as the present application and both incorporated by reference. However, even when the holes are packed as tightly as possible, the open planar area for typical filter dimensions may be on the order of 40%.

In an ink jet system environment, one of the basic objectives of the embodiments of the present invention is to provide a filter which will prevent particles of a size sufficient to block channels from entering the printhead channels and minimize fluid flow resistance due to the filter along the ink flow path.

It is an object of the present invention to provide a microfluidic filtering device with increased surface area.

SUMMARY OF THE INVENTION

According to the present invention, a microfluidic filter has a conical filter structure having a plurality of pores through the structure. Alternately the microfluidic filter can have a cylindrical filter structure or a coil structure of multiple cylindrical filters with decreasing radii. The pore structure of the filters is formed by laser ablation.

Another embodiment of the present invention is directed to an improved ink jet printhead having an ink inlet in one of its surfaces, a plurality of nozzles, individual channels connecting the nozzles to an internal ink supplying manifold, the manifold being supplied ink through the ink inlet, and selectively addressable heating elements for expelling ink droplets, the improved ink jet printhead comprising a conical, cylindrical or coiled cylindrical filter having predetermined dimensions with the filter having a plurality of pores. The filter being bonded within the printhead at the ink inlet or at other points along the ink flow path between the manifold and the nozzle.

Other objects and attainments together with a fuller understanding of the invention will become apparent and appreciated by referring to the following description and claims taken in conjunction with the accompanying drawings.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described. These recited ranges are to be treated as examples only, and are not intended to limit the scope of the claims hereof. In addition, a number of materials are identified as suitable for various facets of the embodiments. These recited materials are to be treated as exemplary, and are not intended to limit the scope of the claims hereof. In addition, the figures are not drawn to scale for ease of understanding the present invention.

It will become evident from the following description of the various embodiments of the present invention that the various embodiments of this invention are equally well suited for use in a wide variety of microfluidic carrying devices, and is not necessarily limited in its application to an ink jet system or the particular thermal ink jet print system shown and described herein. However, a thermal ink jet printing system is being described in detail to give an example of the type of environment (i.e. the kind of microfluidic device) that can be used with the present invention.

Figure 1:
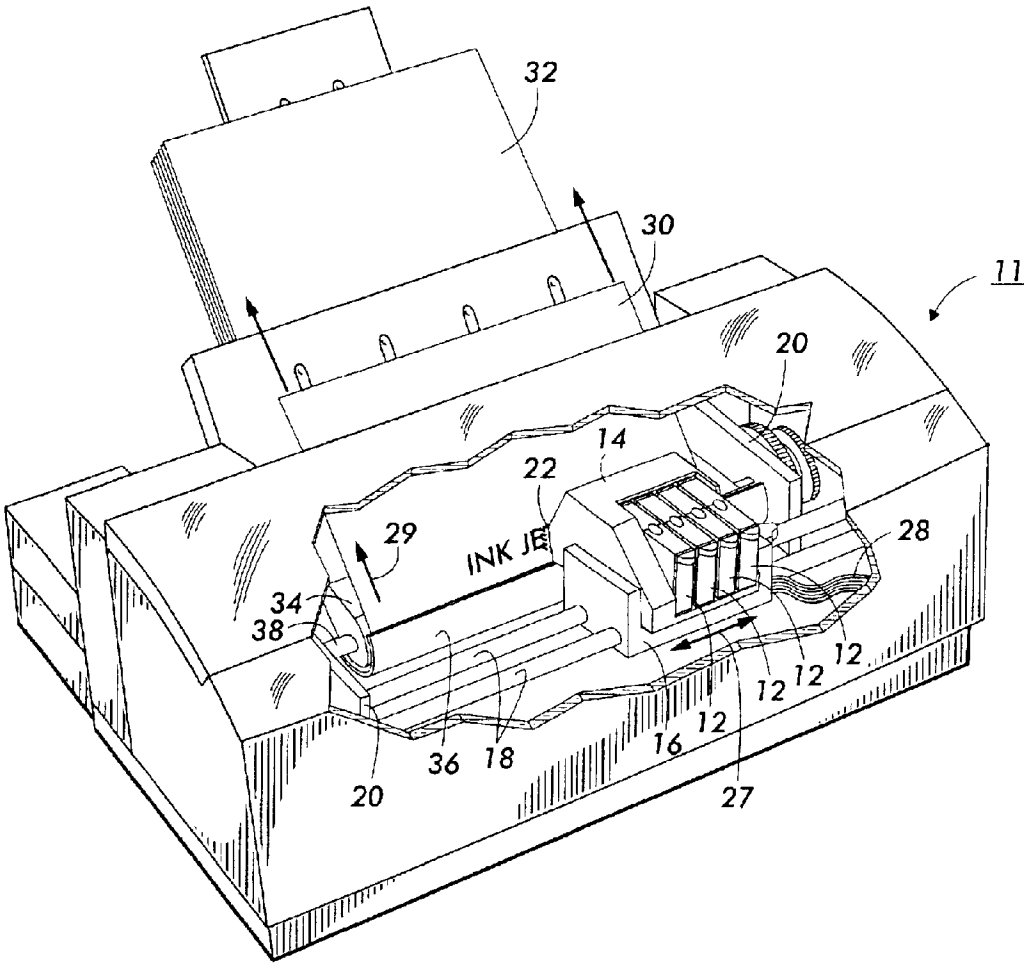
FIG. 1 is an isometric view of a color ink jet printer having replaceable ink jet supply tanks.
Figure 2:
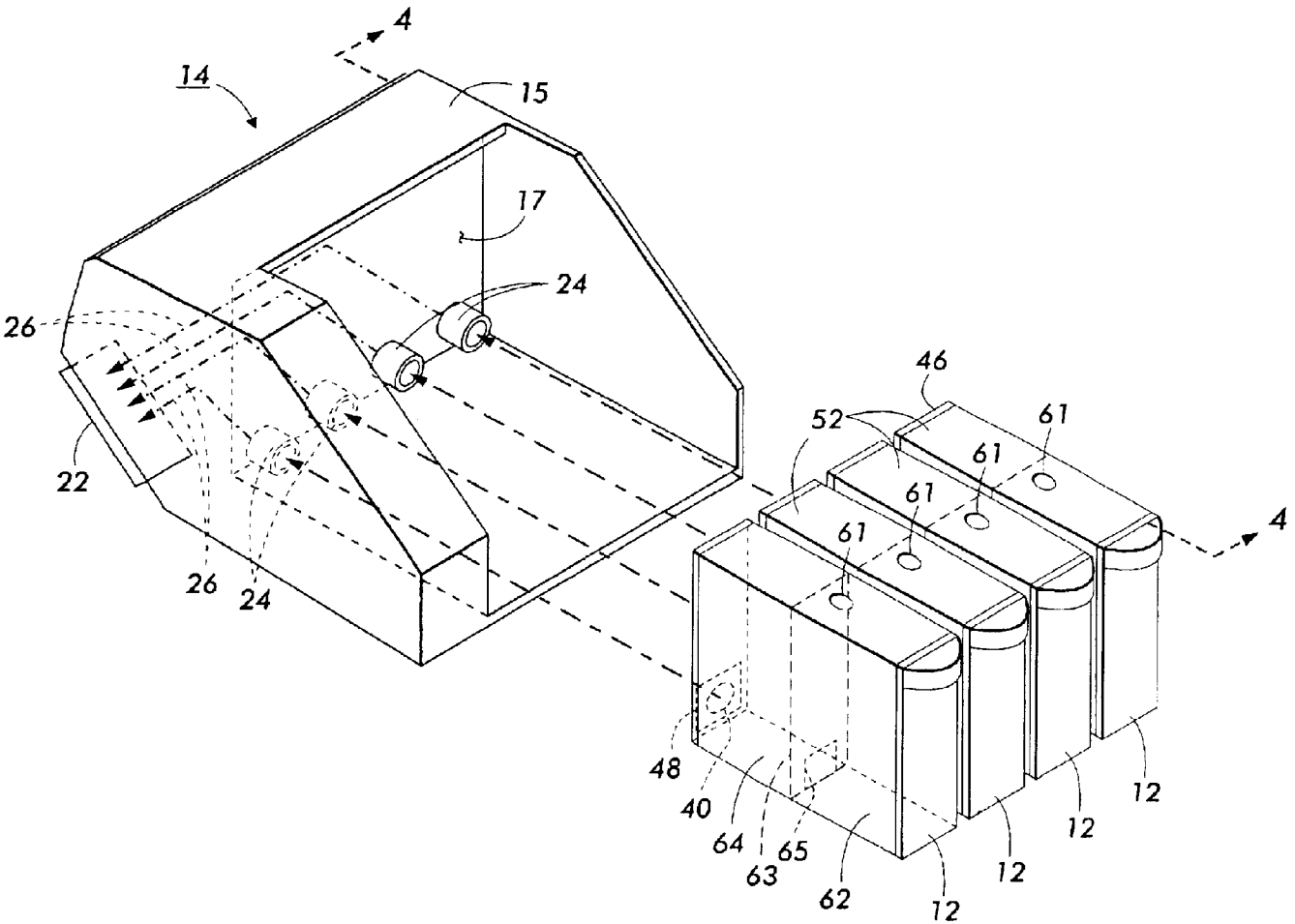
FIG. 2 is a partially exploded isometric view of an ink jet cartridge with integral printhead and ink connectors and replaceable ink tank.

FIG. 1 illustrates an isometric view of a multicolor thermal ink jet printer 11 which can incorporate any of the preferred embodiments of the present invention. The particular printer shown and described herein includes four replaceable ink supply tanks 12 mounted in a removable ink jet cartridge 14. The ink supply tanks may each have a different color of ink, and in a preferred embodiment, the tanks have yellow, magenta, cyan, and black ink. The removable cartridge is installed on a translatable carriage 16 which is supported by carriage guide rails 18 fixedly mounted in frame 20 of the printer 11. The carriage is translated back and forth along the guide rails by any suitable means (not shown) as well known in the printer industry, under the control of the printer controller (not shown). Referring also to FIG. 2, the ink jet cartridge 14 comprises a housing 15 having an integral multicolor ink jet printhead 22 and ink pipe connectors 24 which protrude from a wall 17 of the cartridge for insertion into the ink tanks when the ink tanks are installed in the cartridge housing. Ink flow paths, represented by dashed lines 26, in the cartridge housing interconnects each of the ink connectors with the separate inlets of the printhead. The ink jet cartridge, which comprises the replaceable ink supply tanks that contain ink for supplying ink to the printhead 22, includes an interfacing printed circuit board (not shown) that is connected to the printer controlled by ribbon cable 28 through which electric signals are selectively applied to the printhead to selectively eject ink droplets from the printhead nozzles (not shown). The multicolor printhead 22 contains a plurality of ink channels (not shown) which carry ink from each to the ink tanks to respective groups of ink ejecting nozzles of the printhead.

When printing, the carriage 16 reciprocates back and forth along the guide rails 18 in the direction of arrow 27. As the printhead 22 reciprocates back and forth across a recording medium 30, such as single cut sheets of paper which are fed from an input stack 32 of sheets, droplets of ink are expelled from selected ones of the printhead nozzles towards the recording medium 30. The nozzles are typically arranged in a linear array perpendicular to the reciprocating direction of arrow 27. During each pass of the carriage 16, the recording medium 30 is held in a stationary position. At the end of each pass, the recording medium is stepped in the direction of arrow 29. A more detailed explanation of the printhead and the printing thereby, is found in U.S. Pat. Nos. 4,571,599 and U.S. Pat. No. Re 32572, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink supply tanks 12 is drawn by capillary action through the outlet port 40 in the ink supply tanks, the ink pipe connectors 24, and inflow paths 26 in the cartridge housing to the printhead 22. The ink pipe connectors and flow paths of the cartridge housing supplies ink to the printhead ink channels, replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −5.0 inches of water. One known method of supplying ink at a negative pressure is to place within the ink supply tanks an open cell foam or needled felt in which ink is absorbed and suspended by capillary action.

As shown in FIG. 2, each supply tank 12 comprises a housing 52 of any suitable material, such as, for example, polypropylene which contains two compartments separated by a common wall 63. A first compartment 62 has ink stored therein which is introduced therein through inlet 61. A second compartment 64 has an ink absorbing material 42, such as, for example, an open cell foam member for needled felt member inserted therein. An example of an open cell foam is reticulated polyurethane foam. A scavenger member (not shown) is incorporated adjacent to the outlet port 40 when a needled felt of polyester fibers are used which has greater capillary than the needled felt. Ink from compartment 62 moves through aperture 65 in the common wall 63 to contact the ink absorbing material member (not shown) and saturate the ink absorbing material member with ink. The ink absorbing material member before insertion into the second compartment 64 has between three and four times the volume of compartment 64, so that the ink absorbing material member which in the preferred embodiment is a foam member, is compressed to 25% to 30% of its original size. The second compartment of the ink supply tank 12 has an open end (not shown) through which the ink absorbing material member (not shown) is inserted. Cover plate 46 has the same material as the housing 52 and has an outlet port 40, shown in dashed line. The cover plate 46 is welded into place following foam member insertion into the second compartment of the ink supply tank. Strength of the heat stake weld is important only during the fabrication process, for the filter is otherwise mechanically locked in place by the wall 17 of the cartridge 14 containing the ink pipe connectors 24, and the force from the compressed ink absorbing material member (not shown) when the ink supply tank 12 is installed in the cartridge. This yields a robust construction with an internal retention mechanism that keeps contaminants at their point of origin.

Figure 3:
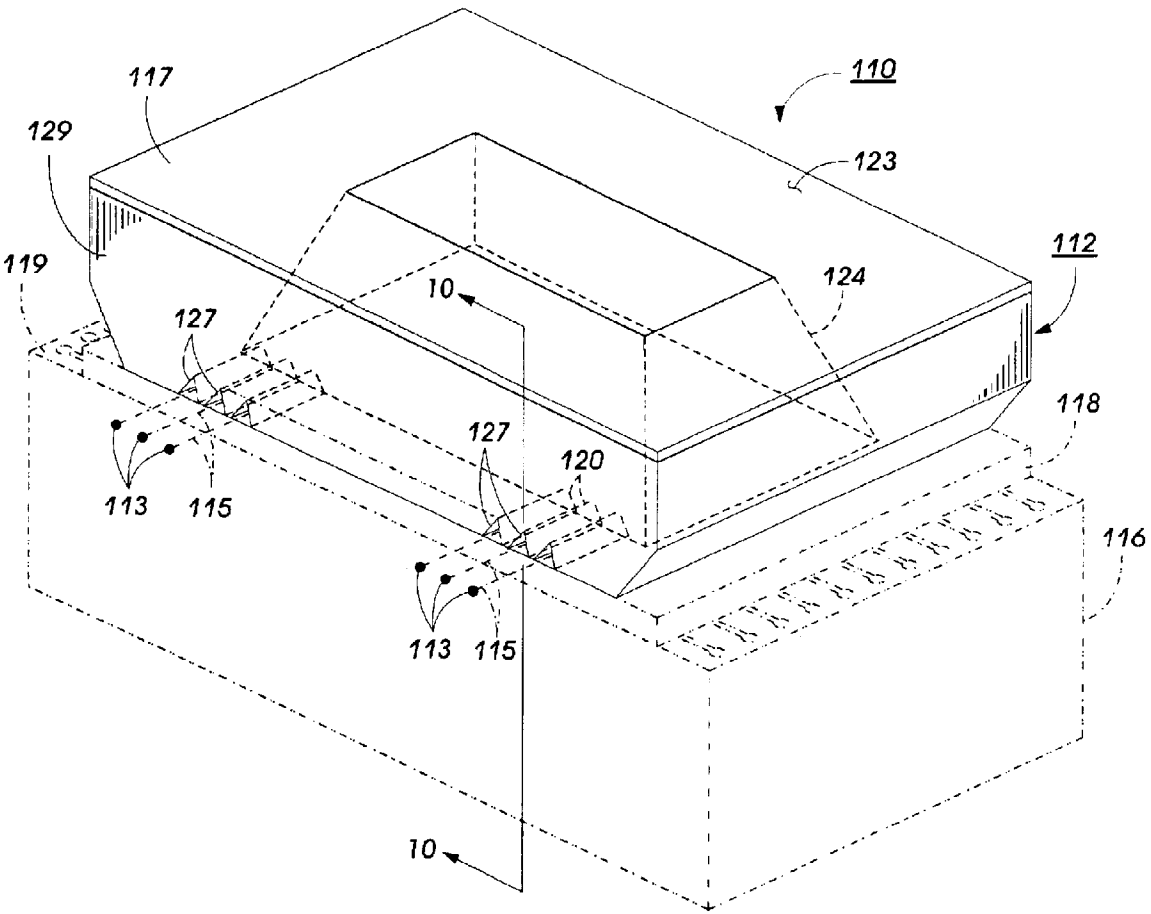
FIG. 3 is a schematic isometric view of an inkjet printhead module.
Figure 4:
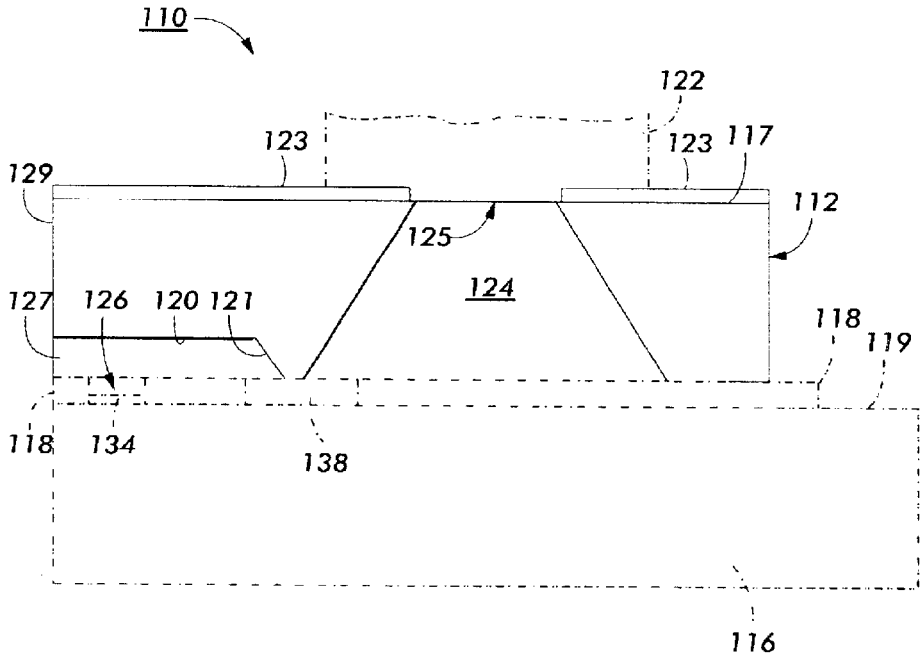
FIG. 4 is a cross-sectional view of the inkjet printhead module of FIG. 3.

Referring to FIGS. 3 and 4, there is shown a die module print head 110 similar to that described in U.S. Pat. No. 6,139,674, having a one possible location 114 for the filter of the '674 patent invention covering its ink inlets 125.

In FIGS. 3 and 4, a thermal ink jet printhead or die module 110 in accordance with present invention is shown comprising channel plate 112 and heater plate 116 shown in dashed line. As disclosed in U.S. Pat. No. 4,774,530 to Hawkins and incorporated herein by reference in its entirety, the thick film layer is etched to remove material above each heating element 134, thus placing them in pits 126. Material is removed between the closed ends 121 of ink channels 120 and the reservoir 124, forming trench 138 placing the channels 120 into fluid communication with the reservoir 124. For illustration purposes, droplets 113 are shown following trajectories 115 after ejection from the nozzles 127 in front face 129 of the printhead.

Channel plate 112 is permanently bonded to heater plate 116 or to the patterned thick film layer 118 optionally deposited over the heating elements and addressing electrodes on the top surface 119 of the heater plate and patterned as taught in the above-mentioned U.S. Pat. No. 4,774,530. The channel plate is preferably silicon and the heater plate may be any insulative or semiconductive material as disclosed in U.S. Pat. No. Reissue 32,572 to Hawkins et al. which is incorporated by reference herein. The illustrated embodiment is described for an edge-shooter type printhead, but could readily be used for a roof shooter configured printhead (not shown) as disclosed in U.S. Pat. No. 4,864,329 to Kneezel et al., incorporated herein by reference, wherein the ink inlet is in the heater plate.

Channel plate 112 of FIG. 3 contains an etched recess 124, shown in dashed line, in one surface which, when mated to the heater plate 116, forms an ink reservoir. A plurality of identical parallel grooves 120, shown in dashed line and having triangular cross sections, are etched (using orientation dependent etching techniques) in the same surface of the channel plate with one of the ends thereof penetrating the front face 129. The other closed ends 121 (FIG. 4) of the grooves are adjacent to the recess 124. When the channel plate and heater plate are mated and diced, the groove penetrations through front face 129 produce the orifices or nozzles 127. Grooves 120 also serve as ink channels which contact the reservoir 124 (via trench 138) with the nozzles. The open bottom of the reservoir in the channel plate, shown in FIG. 4, forms an ink inlet 125 and provides means for maintaining a supply of ink in the reservoir through a manifold from an ink supply source in an ink cartridge 122, partially shown in FIG. 4. The cartridge manifold is sealed to the ink inlet by adhesive layer 123.

The filter structure, i.e., the pore structure for a filter, in accordance with the features of the present invention, is manufactured by a laser ablation system. The laser ablation process functions to effectively remove at least part of the predetermined portion of the material to form the filter pores without the need for chemical or mechanical treatments.

Figure 5:
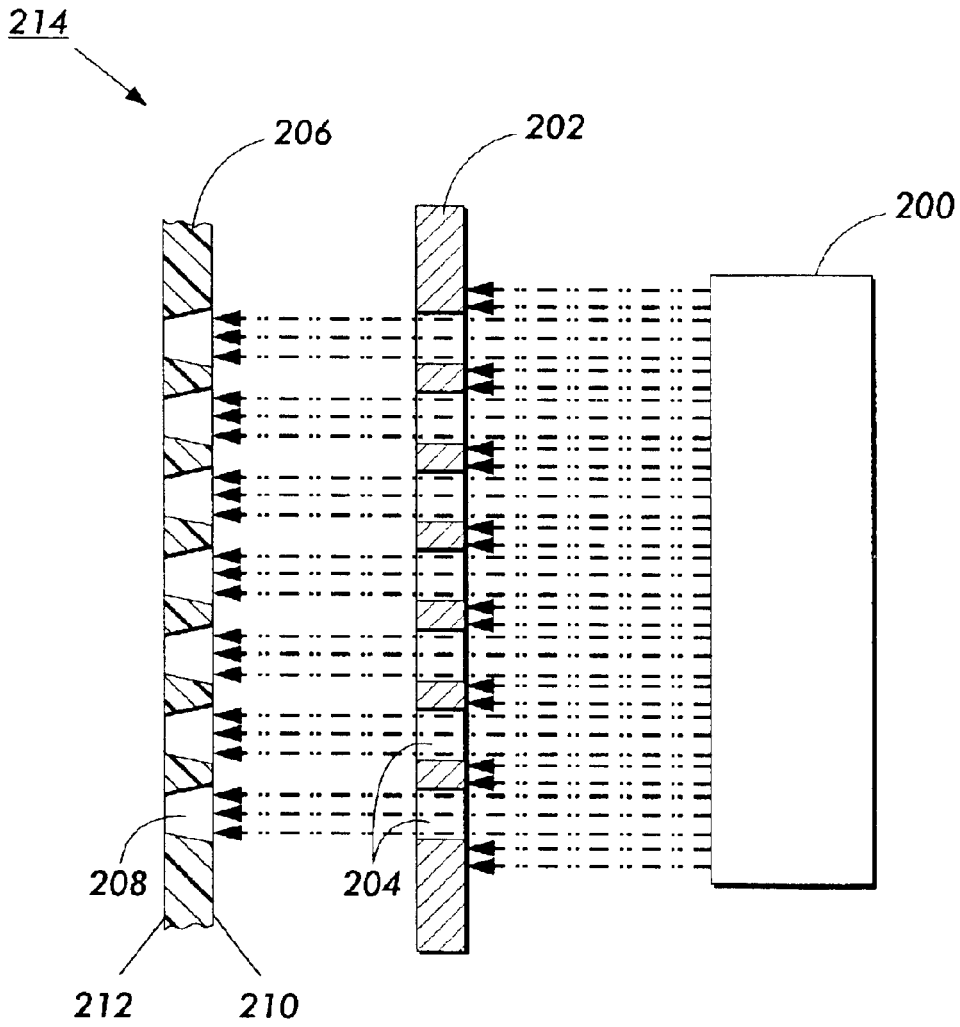
FIG. 5 shows laser ablation through a mask of a thin polymer film to form the filter of the present invention.

Referring to FIG. 5, large diameter output beams are generated by excimer laser 200 and directed to a mask 202 having a plurality of holes 204, with total area sufficient to cover the thin polymer film layer 206, which can be Upilex.

The polymer film layer may also be Kapton or any of other polymer films which are selected for chemical compatibility with the inks and the temperature and pressure of the inks. Examples of other films include polyester, polysulfone, polyetheretherketone, polyphenelyene sulfide, and polyethersulfone. Filters formed by laser ablation can be made of materials that are not commercially available in filter form.

The holes 204 can be closely packed in density with diameters as small as 2.5 microns. The radiation passing through the mask 202 forms a plurality of holes 204 in polymer film layer 206 from the top first surface 210 through to the bottom second surface 212.

Ablated film 206 has thus been fabricated into filter 214 with the holes 204 becoming the filter pores for fluid flow. The filter size must be large enough to provide an adequate seal at the inlet or outlet or location within the printhead with enough edge surface to allow an adhesive layer to be bonded to the edges. The ablated filter or filtering device 214 can then be placed into the fluid flow path between an ink supply cartridge 12 and the channels 124 and nozzles 127 of an ink jet printhead 110.

This present invention describes nonplanar filter configurations in order to increase the filtering surface area.

Figure 6:
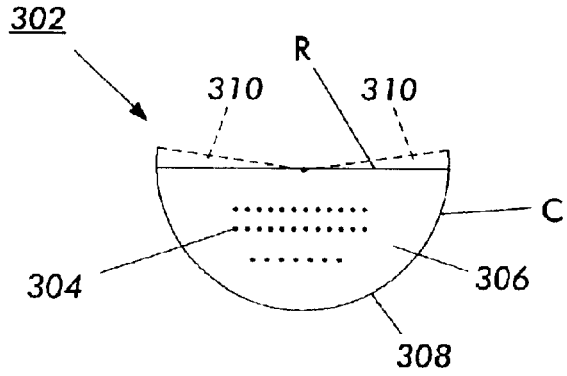
FIG. 6 is a perspective view of a planar semicircular polymer film in accordance with the features of the present invention.
Figure 7:
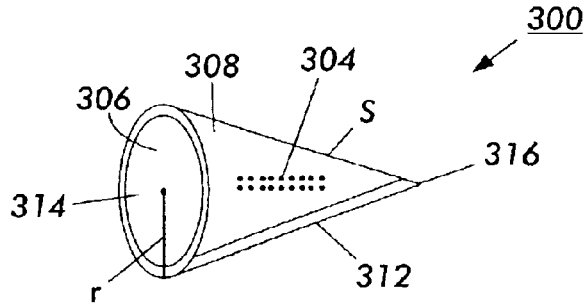
FIG. 7 is a perspective view of a conical filter in accordance with the features of the present invention.

For a conical filter 300 of FIGS. 6 and 7, a planar semicircular thin film polymer layer 302 is laser ablated to form filter pores 304 through the film layer from the top first surface 306 to the bottom second surface 308. The semicircular film layer 302 has bonding areas 310 on one or both sides of the 180 degree semicircle to form an overlap. The semicircular film layer has a radius R and an outside partial circumference length $C=\pi R$ (not counting the overlap region 310).

The planar semicircular film layer 302 is rolled together and the bonding areas 310 are bonded together to form a three dimensional conical filter 300 in FIG. 7. The bonding areas can be coated with an adhesive layer or the bonding can be done by heating or UV curing or solvent welding. The bonded areas form a leak proof seam 312 for the conical filter.

The filter 300 will have an open end 314 and an opposing closed pointed end 316. The inner surface 306 of the conical filter will be connected by the filter pores 304 to the outer surface 308. The filter will have an open end radius $r=R/2$ and a slant length $S=R$. The open end 314 can be the inlet port for fluid flow into and through the conical filter or the outlet port for fluid flow out of the conical filter.

This illustrative example has a semicircular film layer of 180 degrees with bonding end areas of a few degrees on each side.

A circular section of less than 180 degrees and rolled into a cone has a smaller radius open end to the conical filter. Conversely, a circular section of more than 180 degrees has a larger radius open end to the filter. In general, a circular section extending through an arc of $\theta$ degrees will have an open end to the filter of radius $r=R\theta/360$, and a slant length $s=R$. The height of the cone is $H=(R^2-r^2)^{1/2}=R(1-(\theta/360)^2)^{1/2}$.

Figure 8:
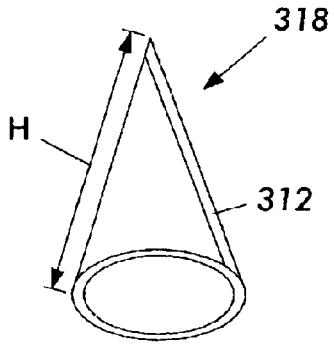
FIG. 8 is a perspective view of a conical structure in accordance with the features of the present invention.

Alternately, the planar circular section film layer 302 can be formed into a conical structure 318 first, with the end areas 310 bonded together in a seam 312, as shown in FIG. 8. The conical structure 318 is then laser ablated to form filter pores to form a conical filter 300 of FIG. 7. There are also other methods of forming, such as molding or casting, to make a conical structure which may be laser ablated to make a conical filter.

Fluid can flow through the conical filter in two different paths.

Figure 9:
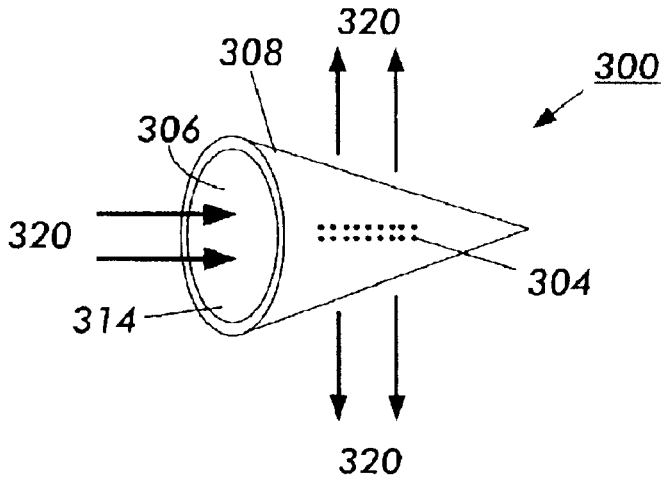
FIG. 9 is a perspective view of fluid flow into the conical filter of FIG. 7.

As shown in FIG. 9, fluid 320 can flow in through the open end 314 or inlet port of the conical filter 300 through the pores 304 in the inner surface 306 and out through the pores on the outer surface 308. Any particles in the fluid larger than the filter pores will be trapped inside the conical filter with clean, particle-free fluid flowing downstream from the conical filter.

Figure 10:
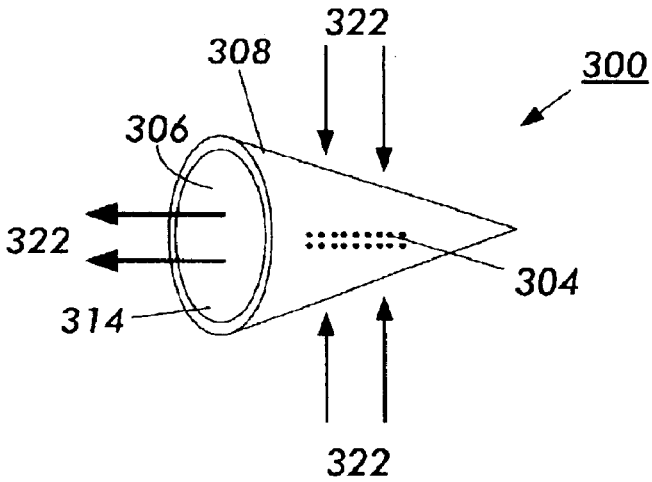
FIG. 10 is a perspective view of fluid flow out of the conical filter of FIG. 7.

Alternately in FIG. 10, fluid 322 can flow around the outside of the conical filter 300 through the pores 304 in the outer surface 308 and out through the pores on the inner surface 306 and out through the open end 314 or outlet port of the conical filter. Any particles in the fluid larger than the filter pores will be trapped outside the conical filter with clean, particle-free fluid flowing downstream from the conical filter.

A planar circular filter bonded over an inlet or outlet having a radius r will have a filtering surface area of $\pi r^2$. The conical filter of the present invention will have a surface area of $\pi r$ s. The slant length $s=(r^2+H^2)^{1/2}$ so $s>r$. Thus, the three-dimensional conical filter has a greater filtering surface area than a planar filter which may be bonded to the same sized fluid passageway.

Figure 11:
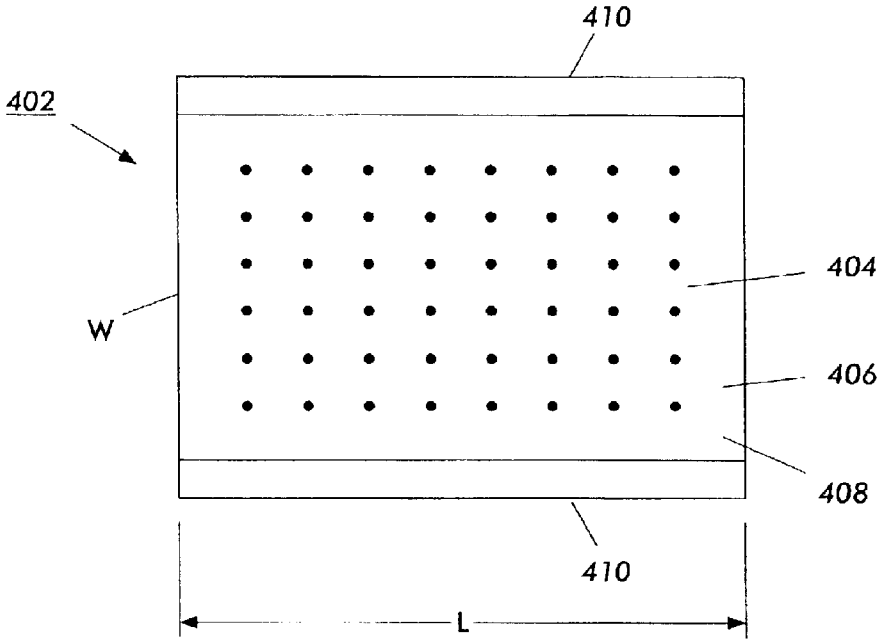
FIG. 11 is a perspective view of a planar rectangular polymer film in accordance with the features of the present invention.

For a cylindrical filter 400 of FIG. 11, a planar rectangular thin polymer film layer 402 is laser ablated to form filter pores 404 through the film layer from the top first surface 406 to the bottom second surface 408. The rectangular film layer 410 has bonding end areas on one or both sides along the length of the rectangle to form an overlap. The rectangular film layer 410 has a width W and a length L.

Figure 12:
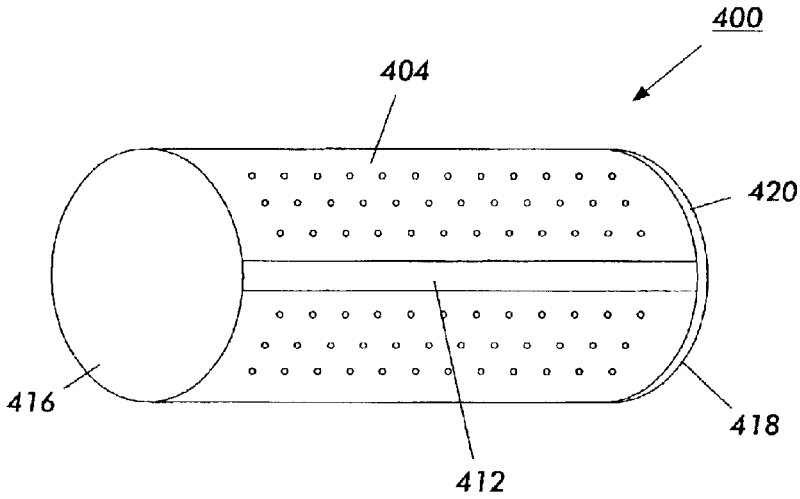
FIG. 12 is a perspective view of a cylindrical filter in accordance with the features of the present invention.

The planar rectangular film layer 402 is rolled together along its length and the end areas 410 are bonded together to form a three dimensional cylindrical filter 400 of FIG. 12. The end areas 410 can be coated with an adhesive layer or the bonding can be done by heating or UV curing or solvent welding. The end areas 410 form a leak proof seam 412 for the cylindrical filter 400.

Figure 13:
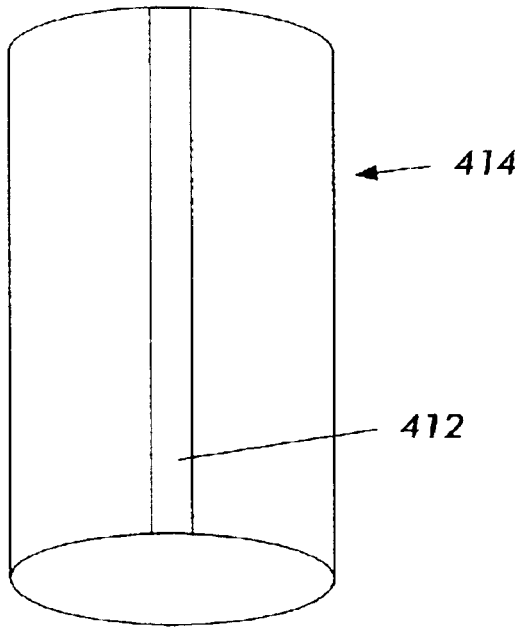
FIG. 13 is a perspective view of a cylindrical structure in accordance with the features of the present invention.

Alternately, the planar rectangular film layer 402 can be formed into a cylindrical structure 414 first, with the end areas 410 bonded together as a seam 412, as shown in FIG. 13. The cylindrical structure 414 is then laser ablated to form filter pores 404 to form a cylindrical filter 400 of FIG. 12. There are also other methods of forming, such as molding or casting, to make a cylindrical structure which may be laser ablated to make a cylindrical filter.

Returning to FIG. 12, one end 416 of the cylindrical filter 400 will remain open. The open end 416 can be the inlet port for fluid flow into and through the cylindrical filter or the outlet port for fluid flow out of the cylindrical filter.

The other end 418 of the filter will be closed. The closed end 418 of the filter can have a flat circle 420 bonded to that end. The flat circle 420 can be the same material as the filter. The flat circle end piece may be laser ablated to form filter pores, not shown in the Figure. Alternately, the flat circle end piece can be a different material than the original planar rectangular film layer.

Figure 14:
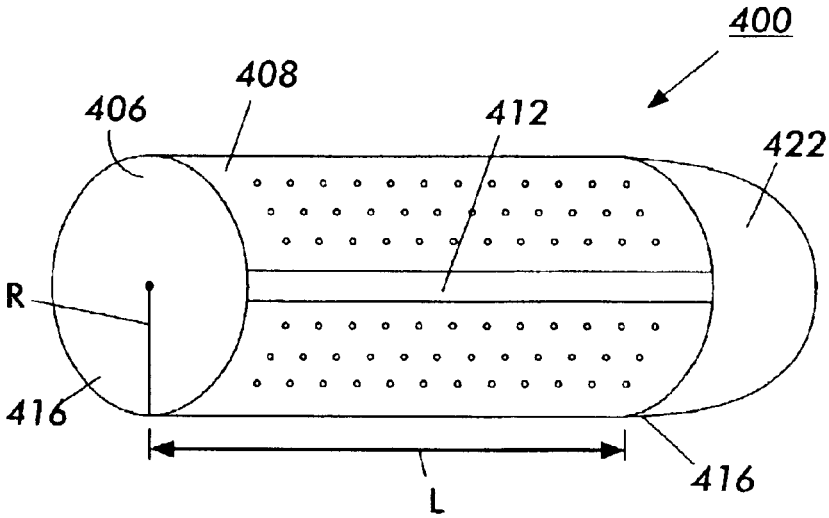
FIG. 14 is a perspective view of a cylindrical filter with a hemisphere closed end in accordance with the features of the present invention.

Alternately as shown in FIG. 14, the closed end 418 of the filter can have a solid plug 422 bonded to and extending beyond that end. The plug 422 can be a different material than the original planar rectangular film layer. The plug 422 need not extend beyond the end 418. Depending upon fabrication conditions and material properties, it may retract within the cylinder and have a concave rather than convex shaped end.

The filter will have an open end 416 and an opposing closed end 418. The inner surface 406 of the cylindrical filter 400 will be connected by the filter pores 404 to the outer surface 408. The filter will have an open end radius $R=W/2\pi$ and a length L.

Fluid can flow through the cylindrical filter in two different paths.

Figure 15:
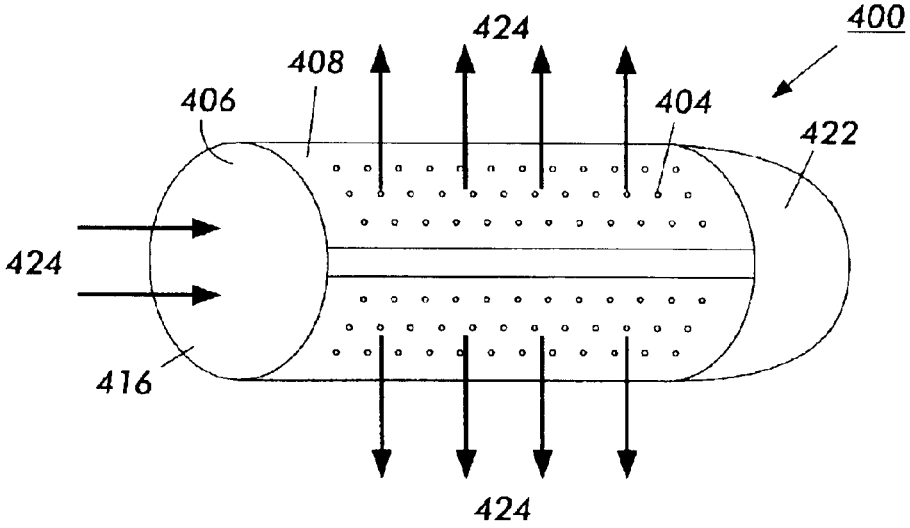
FIG. 15 is a perspective view of fluid flow into the cylindrical filter of FIG. 14.

As seen in FIG. 15, fluid 424 can flow in through the open end 416 or inlet port of the cylindrical filter 400 through the pores 404 in the inner surface 406 and out through the pores on the outer surface 408. Any particles in the fluid larger than the filter pores will be trapped inside the cylindrical filter with clean, particle-free fluid flowing downstream from the cylindrical filter.

Figure 16:
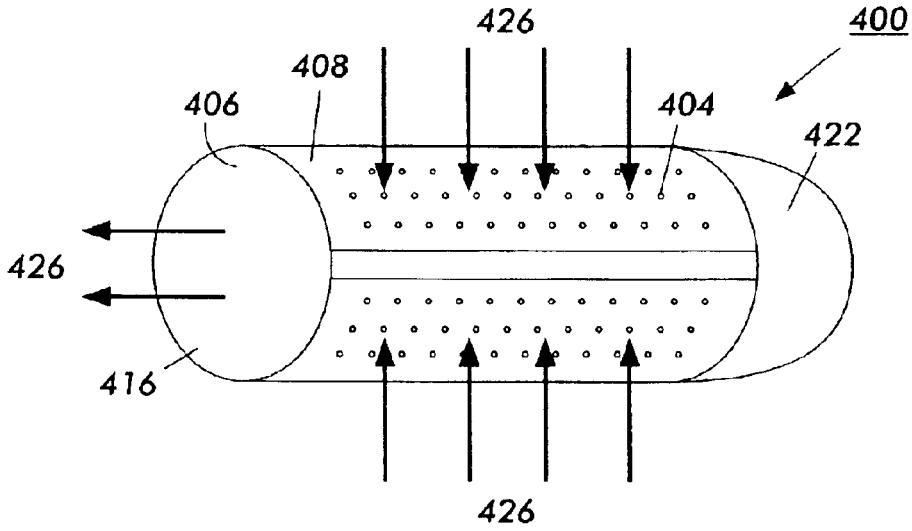
FIG. 16 is a perspective view of fluid flow out of the cylindrical filter of FIG. 14.

Alternately as shown in FIG. 16, fluid 426 can flow around the outside of the cylindrical filter 400 through the pores 404 in the outer surface 408 and out through the pores on the inner surface 406 and out through the open end 416 or outlet port of the cylindrical filter. Any particles in the fluid larger than the filter pores will be trapped outside the cylindrical filter with clean, particle-free fluid flowing downstream from the cylindrical filter.

A planar circular filter bonded over an inlet or outlet having a radius r will have a filtering surface area of $\pi r^2$. The cylindrical filter of the present invention will have a surface area of $2\pi rL$. Effectively, the surface area of the cylindrical filter will be the width W times the length L of the planar rectangular film layer. The three-dimensional cylindrical filter with one end plugged has a greater surface area than a planar filter in the same location in the ink jet printhead, as long as $L>r/2$. For the embodiment where the closed end is capped with a flat circle 420 with pores, then the cylindrical filter has greater filtering surface area independent of length.

Figure 17:
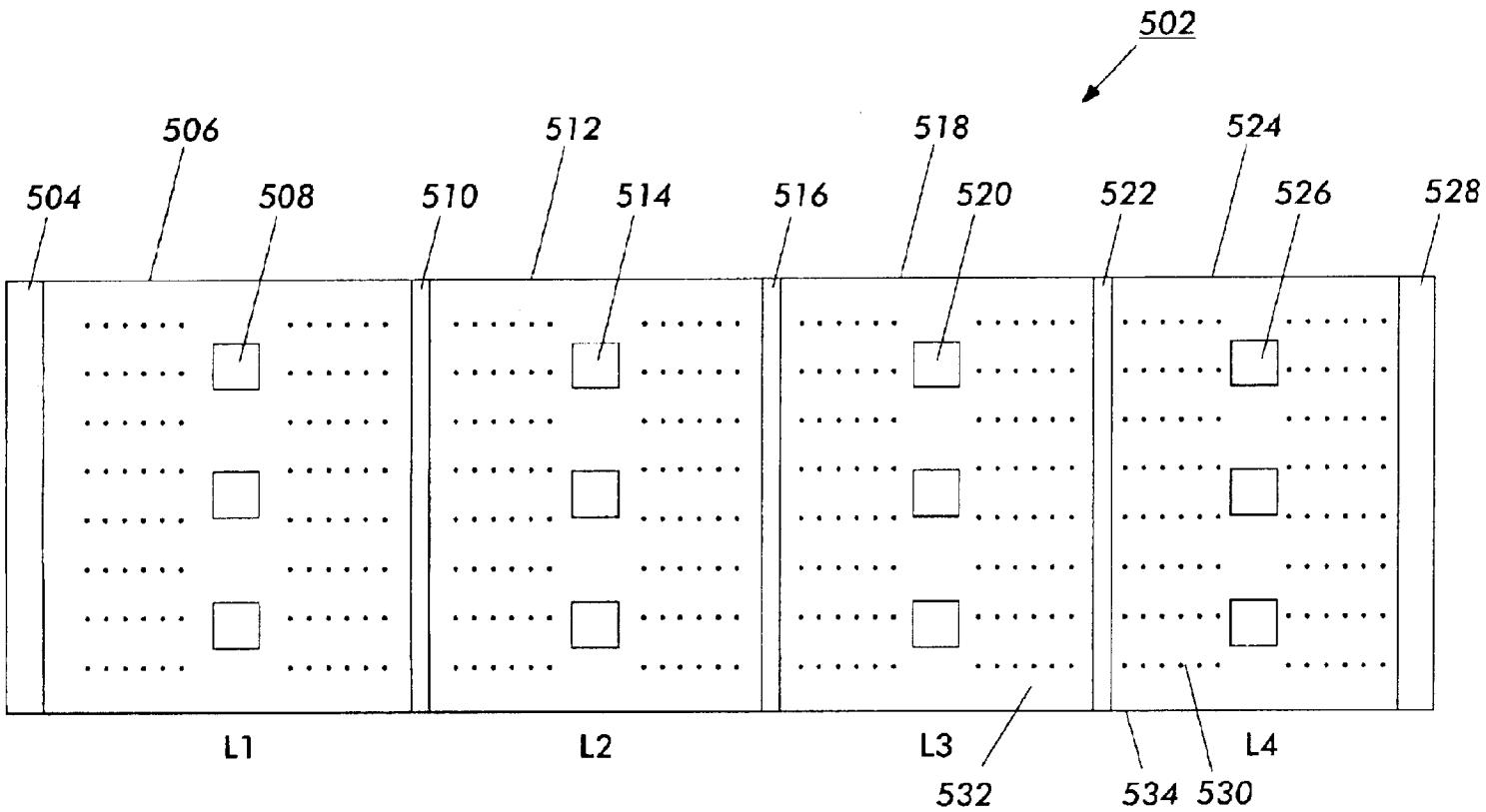
FIG. 17 is a perspective view of a second planar rectangular polymer film in accordance with the features of the present invention.

For a coiled cylindrical filter 500 of FIG. 17, a planar rectangular thin polymer film 502 layer has four sections of decreasing length. The film layer 502 has a first bonding area 504, a first section 506 of a first length L1 with a first row of spacers 508 across the width of the layer in the middle of the first section 506, a second bonding area 510, a second section 512 of a second length L2 with a second row of spacers 514 across the width of the layer in the middle of the second section 512, a third bonding area 516, a third section 518 of a third length L3 with a third row of spacers 520 across the width of the layer in the middle of the third section 518, a fourth bonding area 522, a fourth section 524 of a fourth length L4 with a fourth row of spacers 526 across the width of the layer in the middle of the fourth section 524 and a fifth bonding area 528.

The first section 506 of the film layer 502 will be the longest section in length of the four sections in the film layer. The first length L1 of the first section is longer than the second length L2 of the second section 512, which is longer than the third length L3 of the third section 518, which is longer than the fourth length L4 of the fourth section 524. The fourth section 524 will be the shortest in length.

Regardless of the length of the section, the rows of spacers 508, 514, 520 and 526 will be in the middle of the length of that section. The spacers 508, 514, 520 and 526 will have a height above the film layer 502 and can be formed from the same material as the film layer or a different material.

The planar rectangular thin polymer film layer 502 is laser ablated to form filter pores 530 through the film layer from the first surface 532 to the second surface 534. The planar rectangular film layer will be rolled up from the fifth bonding area 528 and the fourth section 524 along its length to the first bonding area 504. The fifth bonding area 528 will be bonded to the fourth bonding area 522. The fourth bonding area 522 will be bonded to the third bonding area 516. The third bonding area 516 will be bonded to the second bonding area 510. The second bonding area 510 will be bonded to the first bonding area 504.

Figure 18:
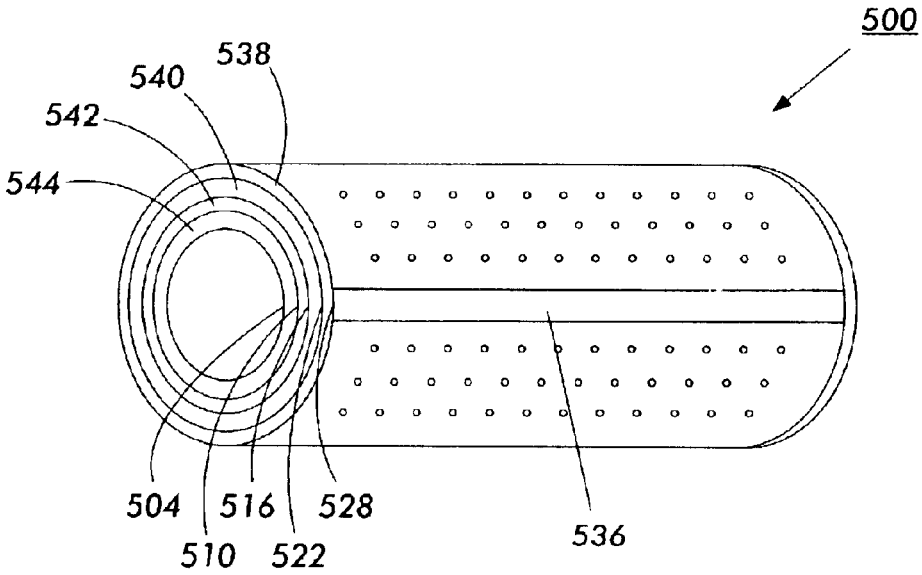
FIG. 18 is a perspective view of a coiled cylindrical filter in accordance with the features of the present invention.

After laser ablation and bonding as seen in FIG. 18, the planar rectangular film layer 502 will form a three dimensional coiled cylindrical filter 500 of off-centered concentric cylindrical filters. The bonding areas can be coated with an adhesive layer or the bonding can be done by heating or UV curing. The bonding areas form a leak proof seam 536 for the coiled cylindrical filter.

The first section 506 of the film layer being the longest and the last to be rolled into the coil will be the widest diameter, outside first cylindrical filter 538. The second section 512 of the film layer will be the next widest diameter, second cylindrical filter inside the first cylindrical filter 540. The third section 518 of the film layer will be the next smallest diameter, third cylindrical filter inside the second cylindrical filter 542. The fourth section 524 of the film layer will be the smallest diameter, fourth cylindrical filter inside the third cylindrical filter 544.

The four offset concentric cylindrical filters 538, 540, 542, and 544 of decreasing radii form the coiled cylindrical filter 500.

The spacer rows 526, 520, 514, and 508 will keep the four cylindrical filters which have different radii separated except at the bonding areas 530, 528, 522, 516 and 510 which are opposite the spacer rows. The bonding areas will be aligned in the coiled cylindrical filter. The spacer rows will be aligned in the coiled cylindrical filter.

Figure 19:
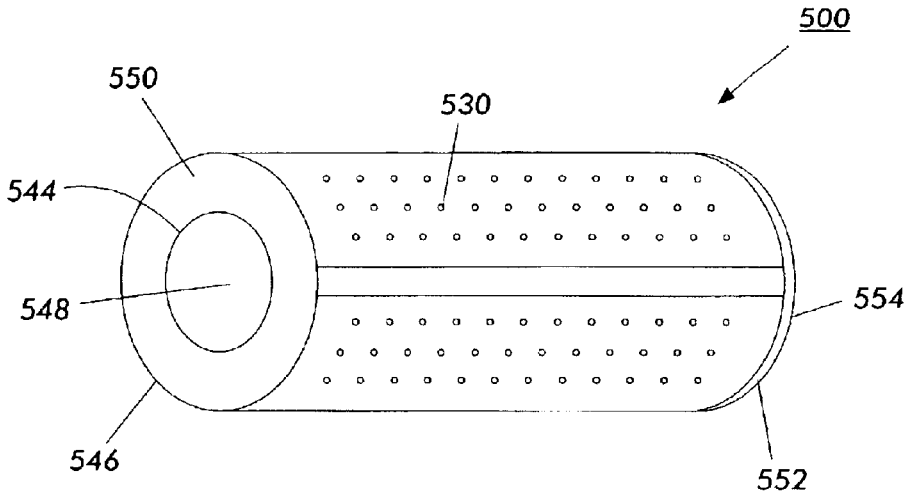
FIG. 19 is a perspective view of a coiled cylindrical filter with a partially open end in accordance with the features of the present invention.

As seen in FIG. 19, one end 546 of the coiled cylindrical filter 500 will remain partially open, specifically the open end 548 of the fourth cylindrical filter 544. The partially open end 548 can be the inlet port for fluid flow into and through the coiled cylindrical filter 500 or the outlet port for fluid flow out of the coiled cylindrical filter 500. An annular ring 550 will be bonded to the first end 546 to cover the ends of the first, second, and third cylindrical filters 538, 540 and 542. Alternately, the ends of the first, second, and third cylindrical filters 538, 540 and 542 can be bonded closed. The circular smallest diameter end 548 of the fourth cylindrical filter 544 will be open. The annular ring 550 can be the same material as the original planar rectangular film layer or a different material. In this embodiment where the successive layers are sealed at end 546, the filter layers operate in series. Configurations are also possible where the successive layers are not sealed at end 546 and the filter layers operate in parallel.

The other end 552 of the filter 500 will be closed. The closed end 552 of the filter can have a flat circle 554 bonded to that end. The flat circle 554 can be the same material as the filter. Alternately, the flat circle end piece 554 can be a different material than the original planar rectangular film layer.

Figure 20:
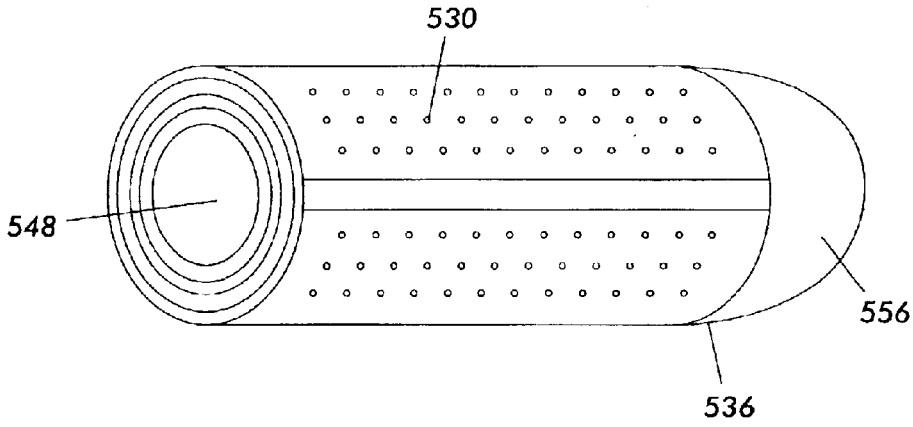
FIG. 20 is a perspective view of a coiled cylindrical filter with a hemisphere closed end in accordance with the features of the present invention.

Alternately as shown in FIG. 20, the closed end 552 of the filter can have a solid plug 556 bonded to that end. The plug can be a different material than the original planar rectangular film layer. It can extend beyond the end 552 of the filter as shown, or it can be retracted within the cylindrical filter.

The coiled cylindrical filter 500 will have an open end 548 and an opposing closed end 556. The inner surface of each cylindrical filter will be connected by the filter pores to the outer surface of that cylindrical filter.

Fluid can flow through the coiled cylindrical filter in two different paths.

Figure 21:
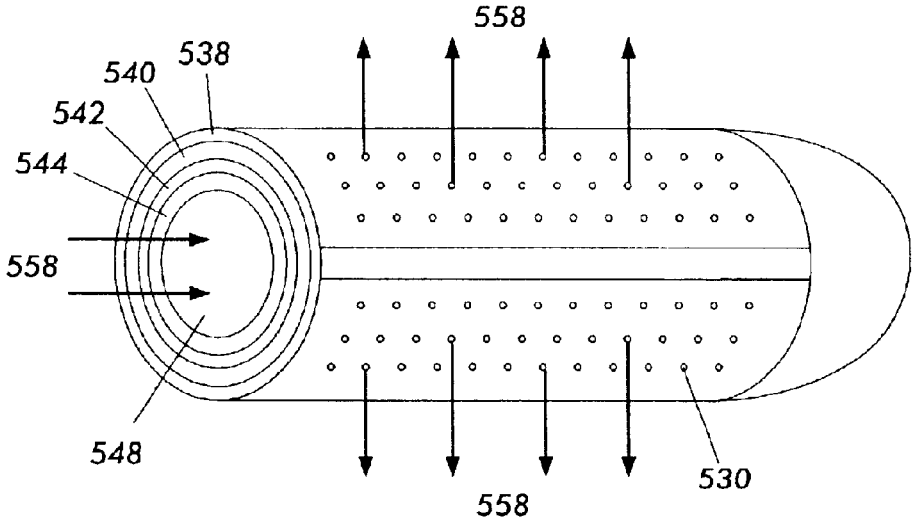
FIG. 21 is a perspective view of fluid flow into the coiled cylindrical filter of FIG. 20.

As shown in FIG. 21, fluid 558 can flow in through the open end 548 or inlet port of the fourth cylindrical filter 544 through the pores 530 in the fourth cylindrical filter, through the pores in the third cylindrical filter 542, through the pores in the second cylindrical filter 540 and through the pores in the first cylindrical filter 538 to the outside of the coiled cylindrical filter 500. Any particles in the fluid larger than the filter pores will be trapped inside the coiled cylindrical filter with clean, particle-free fluid flowing downstream from the coiled cylindrical filter.

Figure 22:
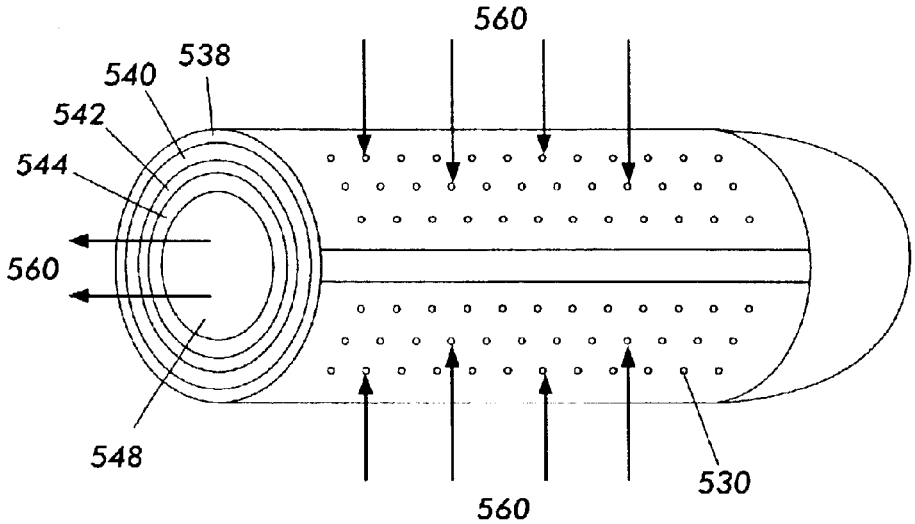
FIG. 22 is a perspective view of fluid flow out of the coiled cylindrical filter of FIG. 20.

Alternately as seen in FIG. 22, fluid 560 can flow around the outside of the cylindrical filter through the pores 530 in the outer surface of the first cylindrical filter 538, through the pores in the second cylindrical filter 540, through the pores in the third cylindrical filter 542, through the pores in the fourth cylindrical filter 544 on the inner surface and out through the open end 548 or outlet port of the fourth cylindrical filter 544. Any particles in the fluid larger than the filter pores will be trapped outside the coiled cylindrical filter with clean, particle-free fluid flowing downstream from the cylindrical filter.

In this example, the coiled cylindrical filter 500 has identical filter pores 530 over the entire surface of all four cylindrical filters.

Alternately, each of the four sections of the film layer and thus each of the four cylindrical filters in the coiled cylindrical filter can have a different filter pore size. This may be particularly advantageous for a coiled cylindrical filter whose successive layers are sealed at end 546 so that the layers operate in series.

For example, the fourth cylindrical filter 544 can have the largest filter pore size, the third cylindrical filter 542 can have a smaller pore size than the fourth filter, the second cylindrical filter 540 can have a smaller pore size than the third filter, and the first cylindrical filter 530 can have the smallest pore size. The cylindrical filters will have decreasing pore size from the inner fourth cylindrical filter to the outer first cylindrical filter.

With the fluid flowing as in FIG. 21, through the open end or inlet port of the fourth cylindrical filter of the coiled cylindrical filter to flow through the decreasing pore sizes of the third, second and first cylindrical filter before flowing outside the coiled cylindrical filter, particles of decreasing size will be trapped by each of the cylindrical filters in sequence.

Alternately, the first cylindrical filter 538 can have the largest filter pore size, the second cylindrical filter 540 can have a smaller pore size than the first filter, the third cylindrical filter 542 can have a smaller pore size than the second filter, and the fourth cylindrical filter 544 can have the smallest pore size. The cylindrical filters will have decreasing pore size from the outer first cylindrical filter to the inner fourth cylindrical filter.

With the fluid flowing as in FIG. 22, through the outside of the first cylindrical filter of the coiled cylindrical filter to flow through the decreasing pore sizes of the second, third and fourth cylindrical filter before flowing out through the open end or outlet port of the fourth cylindrical filter of the coiled cylindrical filter, particles of decreasing size will be trapped by each of the cylindrical filters in sequence.

The filter pores of the coiled cylindrical filter acting in series are larger to smaller in the direction of fluid flow.

A coiled cylindrical filter with n layers will have approximately n times the filtering surface area as a single layer cylindrical filter. Thus it also has greater surface area than the planar filter which is bonded to the same sized fluid passageway.

The coiled cylindrical filter of the present invention can have two or more concentric cylindrical filters of decreasing radii.

The conical, cylindrical and coiled cylindrical filters of the present invention provide a larger surface area for filter pores than a planar filter. The filters of the present invention can be positioned anywhere in the fluid path of the thermal ink jet printhead from ink supply tank to nozzle. The filters of the present invention with their inlet ports or outlet ports can be sealed within the ink jet printhead channels and ink inlets in the fluid path so that ink is forced to flow through the filters.

Although the examples shown in the figures correspond to die module types in which the channels and ink inlets are formed by orientation dependent etching, other fabrication methods for the fluidic pathways are compatible with the laser ablated filter or filtering device described herein. And, although the exemplary laser ablation is accomplished through a mask, alternate light transmitting systems may be used such as, for example, diffraction optics displays or a microlens elements. It should be understood that the efficient filtering device of the present invention can be applied to thermal as well as piezoelectric or other electromechanical ink jet transducers and roof shooter geometries as well as side shooter geometries. More generally it can be applied to microfluidic filtering applications.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A fluid filtering device comprising:

a cylindrical member that includes a bonding area that is formed on a seam of the cylindrical member by overlapping a first end and a second end, said cylindrical member having an open end for fluid flow through said cylindrical member and a closed end, said cylindrical member comprising a laser ablated film material; and a series of fluid flow holes formed through said cylindrical member from a first side to a second side of the cylindrical member.

2. The fluid filtering device of claim 1 wherein said laser ablated film material comprises a polymer film.

3. The fluid filtering device of claim 2 wherein said polymer film is a thin polymer film layer.

4. The fluid filtering device of claim 1 wherein said closed end is a formed by a plug of solid material.

5. An ink jet print head assembly comprising:

ink supplying manifold;

a print head having ink ejecting nozzles;

a fluid path for directing ink from said ink supplying manifold to said ink ejecting nozzles; and a filtering device mounted in said fluid path for filtering such ink, said filtering device including:

a cylindrical member that includes a bonding area that is formed on a seam of the cylindrical member by overlapping a first end and a second end, said cylindrical member having an open end for fluid flow through said cylindrical member and a closed end, said cylindrical member comprising a laser ablated film material; and a series of fluid flow holes formed through said cylindrical member from a first side to a second side of the cylindrical member.

* * * * *